US009185987B1

(12) United States Patent
Nugent

(10) Patent No.: US 9,185,987 B1
(45) Date of Patent: Nov. 17, 2015

(54) ADAPTABLE SEAT CADDY

(71) Applicant: Patrick Nugent, Towson, MD (US)

(72) Inventor: Patrick Nugent, Towson, MD (US)

( * ) Notice: Subject to any disclaimer, the term of this patent is extended or adjusted under 35 U.S.C. 154(b) by 0 days.

(21) Appl. No.: 14/270,860

(22) Filed: May 6, 2014

(51) Int. Cl.
*A47C 7/62* (2006.01)

(52) U.S. Cl.
CPC ..... *A47C 7/62* (2013.01)

(58) Field of Classification Search
CPC ..... A47C 7/62
USPC ..... 297/188.06, 188.2
See application file for complete search history.

(56) References Cited

U.S. PATENT DOCUMENTS

| | | | | | |
|---|---|---|---|---|---|
| 2,061,302 | A | * | 11/1936 | Egler | 297/188.18 |
| 3,014,759 | A | * | 12/1961 | Bing | 297/188.06 |
| 2,979,098 | A | | 4/1962 | Greaves | |
| 3,042,467 | A | * | 7/1962 | Germick | 312/235.8 |
| D292,347 | S | * | 10/1987 | Scott-Smith | D12/416 |
| 4,738,547 | A | | 4/1988 | Brown | |
| 4,813,751 | A | * | 3/1989 | Fenn | 312/235.5 |
| D312,349 | S | * | 11/1990 | Pogue | D12/416 |
| 5,139,308 | A | * | 8/1992 | Ziman | 297/188.06 |
| 5,573,288 | A | * | 11/1996 | Raffensperger | 297/188.12 |
| D392,613 | S | | 3/1998 | Peters | |
| 5,816,463 | A | | 10/1998 | Echeverri | |
| 5,816,643 | A | | 10/1998 | Itou | |
| 5,845,826 | A | | 12/1998 | Nguyen | |
| 6,006,462 | A | | 12/1999 | Lackomar | |
| 6,030,034 | A | * | 2/2000 | Plohetski | 297/188.06 |
| 6,149,229 | A | * | 11/2000 | Dillon et al. | 297/188.2 |
| 6,223,914 | B1 | | 5/2001 | Snell | |
| 6,244,485 | B1 | | 6/2001 | Holland | |
| 6,244,486 | B1 | | 6/2001 | Kagan | |
| 6,402,000 | B1 | | 6/2002 | Stark | |
| 6,450,337 | B1 | | 9/2002 | Campagna | |
| D471,011 | S | | 3/2003 | Kowalsky | |
| 6,874,624 | B2 | | 4/2005 | Redzisz | |
| 7,798,569 | B2 | | 9/2010 | Comarella | |
| 7,891,733 | B1 | | 2/2011 | Clarke | |
| D658,568 | S | | 5/2012 | Currier | |
| 2006/0283899 | A1 | | 12/2006 | Hill | |
| 2008/0073948 | A1 | * | 3/2008 | Livingston et al. | 297/188.2 |

* cited by examiner

*Primary Examiner* — Peter Brown
(74) *Attorney, Agent, or Firm* — Ober, Kaler, Grimes & Shriver; Royal W. Craig

(57) ABSTRACT

A seat caddy for secure organization of personal items at a stadium event and having variable attachment means to permit it to be releasably attached to either the seat back or seat bottom of a standard stadium seat and a method for using same. In a first configurations the seat caddy is releasably attached to the seat back of the seat in front of the user using a strap that wraps around one or more of the horizontal slats of the stadium seat back. In a second configuration, the seat caddy is provided with a hook that hooks the caddy to the back edge of and across the top of the seat base of a stadium seat such that the caddy is disposed in a vertical position at the front edge of the seat base. The caddy contains pockets for holding personal items and that are held in a vertical position according to both methods for attaching the seat caddy to a stadium seat. The caddy is further designed to be waterproof and removable so that a spectator may keep his personal items organized across multiple stadium events.

10 Claims, 3 Drawing Sheets

ADAPTABLE SEAT CADDY

BACKGROUND OF THE INVENTION

1. Field of the Invention

The present invention relates generally to devices for organizing, transporting and storing personal items, and more specifically, to devices for holding personal items at stadium events.

2. Description of the Background

Attending sporting events such as football and baseball is a common recreational activity or hobby for a large number of Americans. For many people, playing in or attending sports games has been a lifelong interest. During sporting events, many enthusiasts enjoy scorekeeping, collecting autographs, or collecting game-day booklets or other types of memorabilia to remember that particular game by or to collect statistics or souvenirs relating to a favorite player or team. Baseball games, for example, generate a wealth of statistics in addition to the number of runs scored in a given game, like RBIs, ERA, errors, saves, batting average, etc. Thus, for many years, many baseball enthusiasts make a hobby out of keeping score during games in which their favorite team plays, including keeping detailed track of all statistics earned by the team and each player, and often consider those records to be keepsakes akin to a baseball card collection or game ball. Often, the organizers or vendors at professional or semi-professional (or even club or amateur) sporting events will cater to an enthusiast's desire to keep track of game play or obtain mementos of the game by handing out player bios, custom scorecards, keepsake tchotchkes, or the like for fans to collect, carry with them and refer to during the game and/or take home afterwards.

Also for many people, attendance at sporting events is a full day or full afternoon outing during which the average attendee will need to carry important personal effects on his or her person or in a bag or organizer for the entirety of the outing. In these instances, it is often necessary to have certain personal items or documents organized such that they may be easily accessed by the user; i.e. a ticket stub ready to show to an usher or security guard when entering a stadium or when leaving and returning to your seat, reading or sun glasses, cellular phone, and pen-and-paper on which to make notes or keep statistics during the game or to obtain a player's autograph.

In a typical baseball or football stadium, the seating generally consists of individual, slatted plastic or metal chairs with a fixed back, fold-down seat, and in some cases, shared armrests. Although generally similar in many venues, the precise size, spacing and construction of the seating in different venues varies significantly. In many cases the underside of each seat is occupied by structural hardware for the seat itself or foot room for the occupant of the seat behind it such that there is little space for a fan to store personal items. Even when there is space underneath of a stadium seat to place personal belongings of the type that a fan normally brings to a sporting event, the area underneath a seat is often dirty, sticky, wet, or prone to being stepped or spilled upon such that scorecards or delicate souvenirs stored there are at risk of being soiled and ruined. Further, personal items stored under the seat are not quickly and easily accessible when a run is scored or personal article needed.

Accordingly, a device meant to contain and organize personal items in a readily accessible manner at a sporting event would be desirable. It is also desirable that such a storage device be removable so that event attendees can take the organizer with them to safeguard against leaving small items behind (a common occurrence when attendees are forced to store personal items underneath their seats and out of sight) and also to ensure that the frequent attendee who wants to ensure that certain items are brought to each event may keep those items organized in the device between events or throughout the sports season. Finally, it would be desirable that such a device be adaptable to be affixed in multiple modes to all manner and geometry of sporting arena seating so as to accommodate the variety of seating types and dimensions in different venues.

Prior art devices for holding small personal items are not well suited for use at sporting events or with bleacher-style chairs as described above. For example, U.S. Design Pat. No. 392,613 depicts an organization device meant to be draped over the armrest of a chair such as those in a recreational vehicle or on a boat. However, if the typical seats at a stadium event have any armrests at all, they are shared armrests with no lateral space between the armrest and the seat bed or between the armrest and the neighboring chair, such that use of the device described in the '613 patent would infringe on the personal space of the user's neighbor. In addition, any available armrests at most stadium events are narrow and often without the length to support a device of sufficient size to hold a useful number of personal items.

In addition, U.S. Pat. No. 5,816,463 discloses a "Sports Pack" that is attachable to the underside of a stadium-type seat through the use of elastic straps which wrap around and contact all sides of the seat base, including an integral seat cushion that covers the top of the seat base. This device is designed to hold personal items in a horizontal orientation, which is not generally conducive to organizing smaller personal items that might fall out of the device's one large pocket when the bag is turned on its side, and is capable of use only with a specific type of stadium seating due to the length of the straps and the fit of the bag and cushion on the surface area of the seat base. The cushion described therein may also prevent the standard fold-down stadium seat from fully or properly closing, such as when the user stands up to allow additional spectators to pass by. Moreover, the contents of the bag are not visible to the user in his seated position, and therefore are not quickly accessible as the user will be required to fish around underneath his seat in order to grasp any of them.

Therefore, what is needed is a removable device for storing small or delicate personal items at a public seated event, whose attachment means allows it to be quickly and easily attached to and removed from any seat of the type typically found at stadium events. The device would advantageously hold a user's personal items in clear view and in a vertical orientation, and comprise pockets to organize and secure small personal items for ready access. Moreover, such a device must not interfere with the personal space of any other attendees of the event nor with any walkway, ingress or egress from the seating area where other spectators may pass.

SUMMARY OF THE INVENTION

Accordingly, there is provided a seat caddy device that is alternatively attachable to the seat back of the seat immediately in front of a spectator or to the seat base of his own seat. In a preferred embodiment, the caddy has three wide compartments for a score pad or the like, which compartments are covered by a Velcro-attached flap, two additional side compartments suitable for holding a thin object like a writing implement, and a grommet for holding a key ring or the like. Regardless of how it is attached or of the position of the seat base, the instant seat caddy device stores the items in its pockets in a vertical position for easy viewing by the user and to prevent the items from spilling out. The instant caddy has a thin profile and is designed to be positioned off of the ground and out of the way of foot traffic and of other seated spectators while in use.

The foregoing objects, features and attendant benefits of this invention will, in part, be pointed out with particularity and will become more readily appreciated as the same become better understood by reference to the following detailed description of a preferred embodiment and certain modifications thereof when taken in conjunction with the accompanying drawings.

DETAILED DESCRIPTION OF THE PREFERRED EMBODIMENTS

Figure 1:
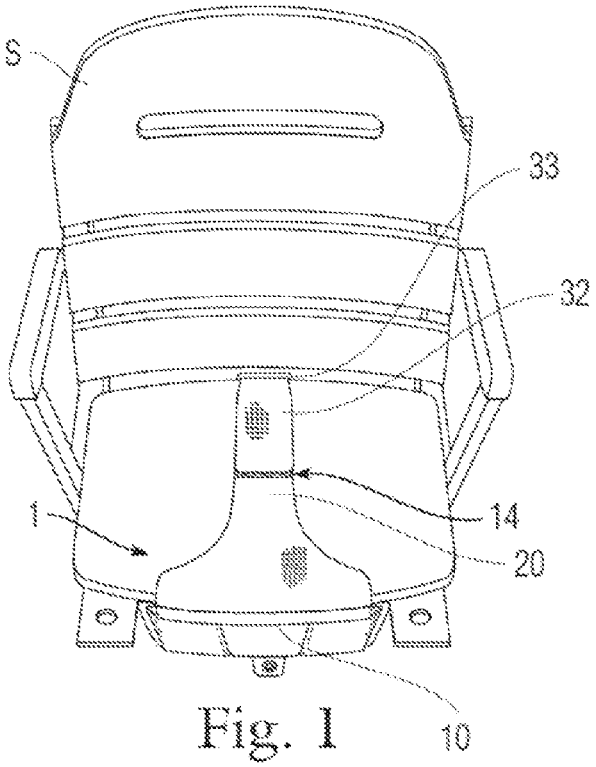
FIG. 1 is a perspective view of an adaptable seat caddy according to the present invention as adapted to attach to a seat base from the front with the seat in the open position.
Figure 2:
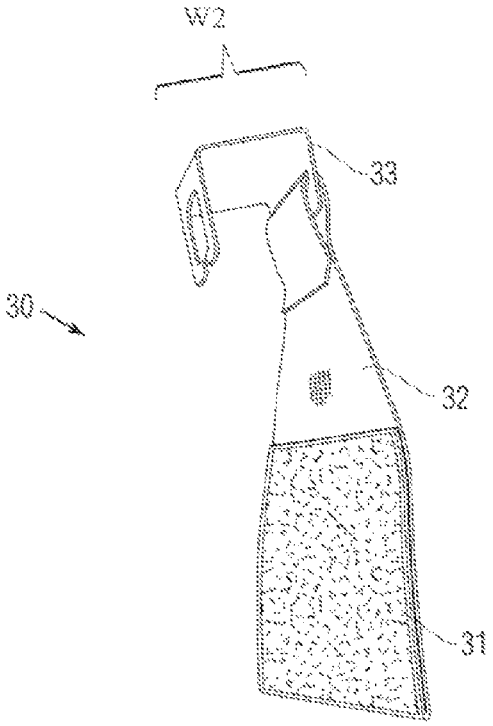
FIG. 2 is a perspective view of the adaptation hook according to the present invention from the side.
Figure 3:
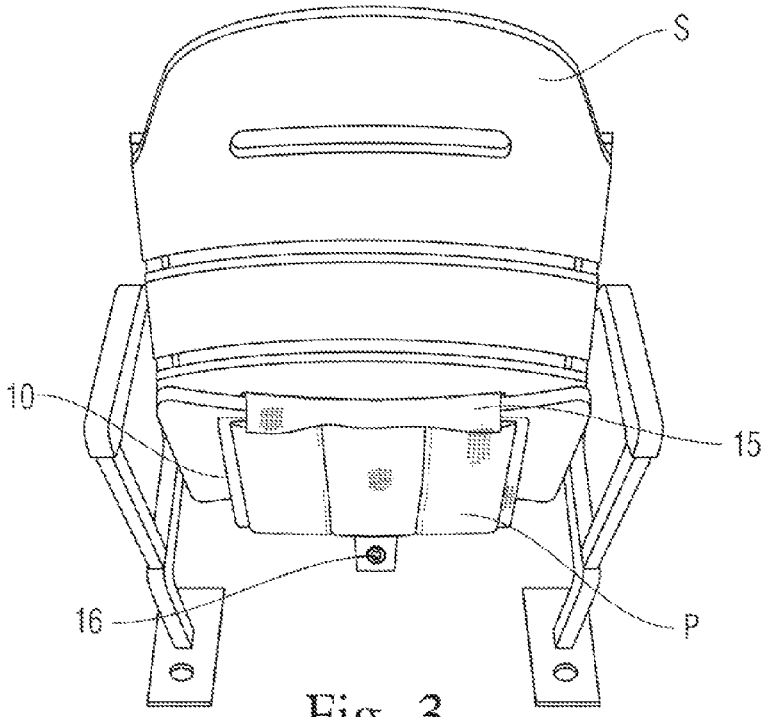
FIG. 3 is a perspective view of an adaptable seat caddy according to the present invention as adapted to attach to a seat base from the front with the seat in a closed position.

With general reference to FIGS. 1 through 5 and specific reference to FIGS. 1 and 3, an adaptable seat caddy 1 according to the present invention comprises a flexible fabric body 10 and seat connecting strap 20 extending from the body. The body 10 and strap 20 are preferably constructed in a unitary fashion from a base layer 11 which underlies both the body 10 and the seat connecting strap 20 as will be described herein. As a whole, the body 10 has a generally rectangular shape with a width W of less than the width of a standard stadium seat but large enough to accommodate at least one and preferably three or more pockets, arranged width-wise, each having sufficient size to hold a notepad or other small object therein. Thus, body 10 is preferably between ten and twenty-four inches wide, and is more preferably between twelve and sixteen inches wide. The body 10 further has a height H of no greater than the height of a seat back of a standard stadium seat, but no less than the size needed to accommodate one or more pockets, arranged height-wise, each having sufficient size to hold a notepad or other small object therein. Accordingly, the body 10 is preferably between two and twenty inches in height, and is most preferably between six and twelve inches in height.

Base layer 11 thus preferably has the general dimensions described with respect to body 10, above, for forming the base of body 10. In addition, and with specific reference to FIG. 1, base layer 11 extends upward from the top of the body 10, perpendicularly to the lateral axis of the elongate width-wise rectangle that forms body 10, to form a strap 20. The strap 20 joins with base 10 at its proximal end where it preferably has the same width as body 10 so as to support the body 10 and its pockets P in a stable, vertical orientation without lateral swinging, as will be described. The distal end of the strap 20 preferably has a width of approximately ⅓ that of body 10 and the strap 20 is quickly tapered along its length to this width to allow it to pass easily through the slats in the seat back of a typical stadium seat as will be described. It will be understood that any references made herein to the positional terms up, down, vertical, horizontal, front, back etc. are for reference only in relation to the figures (FIGs.) provided herein, and are not meant to limit the instant invention.

Base layer 11 is preferably constructed from a waterproof natural synthetic textile, such as canvas or nylon, but may also be formed from any other sturdy fabric material known in the art such as cotton or any synthetic or non-synthetic material, regardless of whether it is waterproof, that has sufficient flexibility to be wrapped around the slats of a seat back of a standard stadium seat as will be described. Base layer 11 thus forms the combined shape of body 10 and strap 20. Alternatively, base layer 11 can be separately formed into the shapes of body 10 and strap 20 and then joined together to form caddy 1 by stitching, adhesive or other means known in the art. It will also be understood that base layer 11 is not necessarily a single layer of material, but may be made up of multiple layers of material joined along their edges by stitching or by other means known in the art. In a preferred embodiment, base layer 11 is made of two identically-shaped pieces of Nylon (or other fabric) placed one on top of another and sewn together continuously along their outer edges to form the shape of base layer 11.

Figure 5:
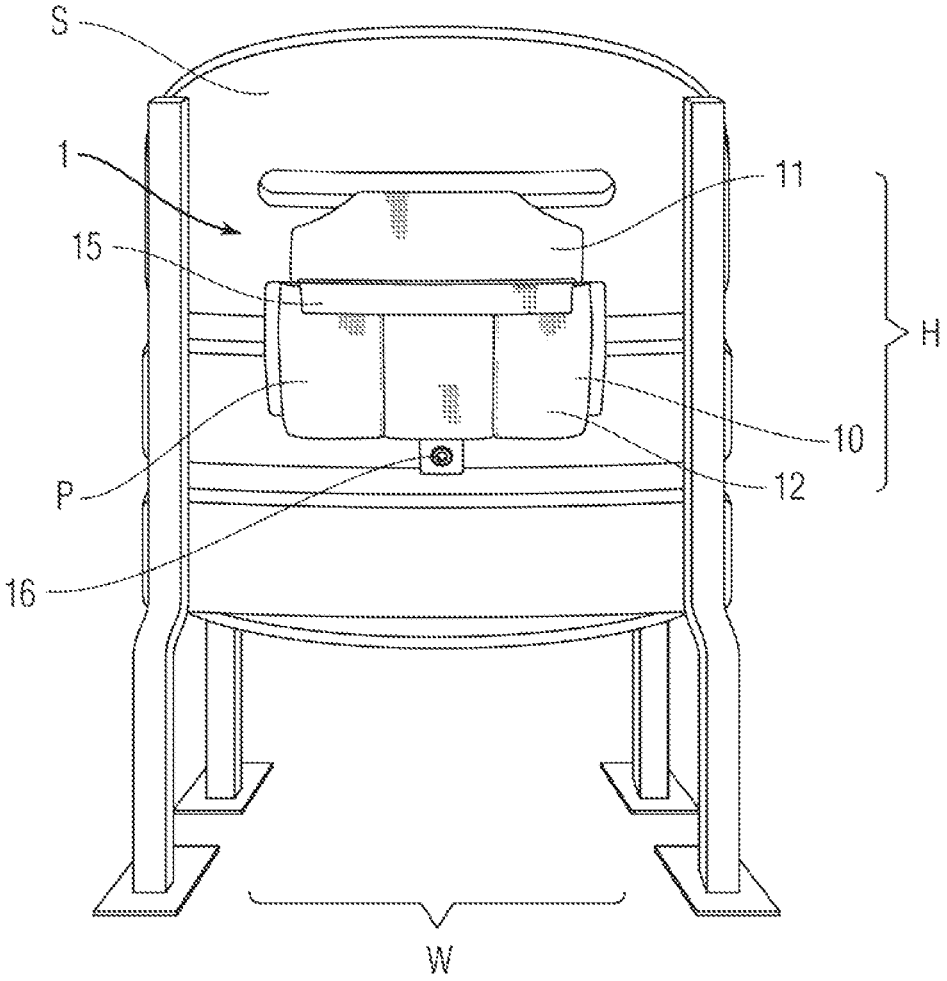
FIG. 5 is a perspective view of an adaptable seat caddy according to the present invention as adapted to attach to a seat back from the back.

With reference to FIG. 5, a top layer 12 is affixed to the front of base layer 11 as by stitching or the like to form a pouch or series pockets P in which to store one or more personal items. Top layer 12 is typically a rectangular piece of material sized to form a desired pocket configuration. Top layer 12 may be formed from one of the same materials as described above with respect to base layer 11, and is preferably but not necessarily formed from the same material as base layer 11. As shown in FIGS. 1 and 5, the top layer 12 is attached to base layer 11 at intermittent points to form three pockets P between base layer 11 and top layer 12. In the depicted embodiment, top layer 12 is sewn to base layer 11 continuously along the width-wise edge of base layer 11, opposite the edge to which strap 20 attaches, and along both height-wise sides of base layer 11. In addition, top layer 12 is sewn to base layer 11 along the height of base layer 11 at two evenly-spaced points along the width of base layer 11, parallel to one another, as shown in FIG. 5; i.e. at a point ⅓ of the way across the width of base layer 11 from each side of base layer 11. In this embodiment, the points of attachment between base layer 11 and top layer 12 are equally spaced with respect to top layer 12 but this need not be so and the skilled artisan will recognize that alternate pocket configurations may be selected as described below. The depth of the pockets (away from the plane of the surface of the base later 11) are preferably between ½ and three inches to accommodate small items as described, and may vary between the pockets.

The base layer 11 and top layer 12 are not attached along the top of the pockets to allow items to be inserted into pockets P but, in a preferred embodiment, a flap 15 is provided to releasably cover the openings of pockets P so as to better retain and protect the contents. Optionally, the flap 15 may be releasably attached to body 10 using Velcro® (i.e., hook-and-loop) or some other means of attachment known in the art to further secure personal items inside pockets P. In an alternate embodiment, the flap may be replaced by alternate pocket closure means such as a zipper, Velcro® or snap, as will be understood by those skilled in the art.

Although the invention is described herein as having three pockets P of equal size, it will also be understood that body 10 may comprise more or fewer pockets, and that pockets P may be of different widths. These dimensions may be chosen as a matter of design choice to hold personal items that one would anticipate carrying to a stadium or other event. Thus, an alternate caddy 1 may have one small (approximately 1 inch wide) pocket to accommodate ticket stubs, and one large (approximately 8 inches wide) pocket to accommodate keepsakes or beverages. In addition, the depth of pockets P may be variable, such that one pocket has a depth of greater than one or more other pockets, by varying the points along the width of top layer 12 along which it is sewn to base layer 11 as will be understood by one having ordinary skill in the art. Also in a preferred embodiment, a hole and grommet 16 through the body 10 or a tab extending therefrom is provided in which to secure keys or other items with a corresponding ring. The grommet 16 is preferably located at approximately the middle of the width-wise edge of pouch 10 opposite its attachment to strap 20.

Figure 4:
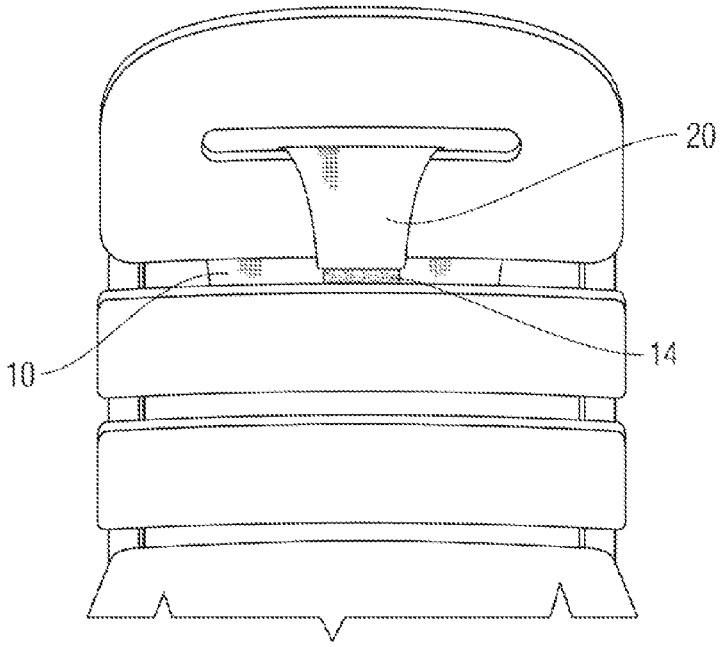
FIG. 4 is a perspective view of an adaptable seat caddy according to the present invention as adapted to attach to a seat back from the front.

With reference to FIG. 1, the strap 20 is provided with attachment means 14 at its distal end and preferably extending a distance of approximately one-third to one-half the length of the strap from the distal end toward the body 10. The attachment means 14 are preferably affixed to the front of the strap 20. As used herein, the term "front" refers to that side of base layer 11 to which the top layer 12 is affixed to form pockets P, and the term "back" refers to the side opposite the front side. Again, the terms front and back are not meant to be limiting on the instant invention but are used for illustration only with reference to the FIGs. included herein. The attachment means 14 is preferably one half of a complementary attachment means such as the cooperating patches of hook-and-loop fastener (i.e., Velcro®), snaps, buttons or the like so as to be repeatably and removeably fastened. The attachment means 14 (partially hidden by corresponding attachment portion 31 on hook strap 32 in FIG. 1) is preferably disposed across the entire width of the distal portion of strap 20, and along approximately two to three inches of the height of the distal portion of strap 20 starting at the terminating end of strap 20, on the front side of the strap 20. With reference to FIG. 4, a complementary attachment means 13 is affixed to the back side of the body 10 along the vertical midline such that the strap 20 may be looped over the horizontal slats in the seat back of a typical stadium seat and the attachment means 14 secured to the complimentary attachment means 13 to secure the caddy 1 to the seat back as depicted in FIGS. 4 and 5. In this configuration the contents of the pockets P are presented to the user sitting in the seat behind that to which the caddy is affixed.

Thus, in operation, upon finding his seat at a stadium or event or the like, the user attaches caddy 1 to the back of the stadium seat in front of him by feeding strap 20 between adjacent slats in the seat back, around the lower of said slats, and back out through the space between that lower slat and the slat immediately below it, as shown in FIG. 4. Then, attachment portion 14, disposed on the strap 20, may be aligned with attachment portion 13 disposed on the back of body 10. As a result, the front of body 10 containing pockets P is exposed to the user and hanging from the seat back in front of him.

When used in this way, caddy 1 is designed to be as unobtrusive as possible to the spectator sitting in the seat in front of the user. As shown in FIG. 5, the only portion of caddy 1 that interferes with the personal space of the spectator in the seat to which caddy 1 is attached is a portion of strap 20. In addition, as shown in FIG. 5, body 10 sits nearly flush against the back of seat S and has a minimal intrusion into the walkway behind seat S. However, it may not always be feasible or desirable to attach the caddy 1 to the seat in front of the user such as if the occupant objects or the user is not sitting in a seat that is directly behind another seat in the stadium. Thus, the caddy 1 also consists of an alternate hook mechanism 30 as shown in FIG. 2 to secure the caddy to the user's own sea in the manner depicted in FIG. 1.

With reference to FIG. 2, the hook mechanism 30 includes a rigid hook 33 that forms a U-shape as shown in FIG. 2 with sufficient width W2 to accommodate the height of the seat base of a typical stadium seat. Thus, hook 33 may have a width W2 of between ½ inch and three inches, and preferably has a width W2 of approximately 1 inch. The hook 33 is preferably formed from a hard plastic material, but may alternately be made of metal or other durable material that is capable of holding a shape and securely fastening caddy 1 to the seat base of a stadium seat as will be described. A strap 32 is permanently or releasably affixed to the hook 33 at one side of the U shape and extends away from the U shape toward a distal end. The strap 32 is preferably formed of the same material as base layer 11, and is preferably permanently secured to the hook 33 by being looped through a slot formed in the side of hook 33, folded back on itself and sewn in place as shown in FIG. 2.

The remainder of hook strap 32 forms an elongate strap with a comparable width to that of the distal end of strap 20. Attachment means 31 is affixed to the distal end of the strap 32 and is selected for complementary engagement with the attachment means 14 provided at the distal end of strap 20, as seen in FIG. 1. The attachment means 13, 14, are preferably universally engageable (as is the case with complementary patches of hook-and-loop fastener) such that the overall length of the joined straps 20, 32 is adjustable by selective positioning of the strap 32 relative to the distal end of the strap 20.

As noted, attachment means 31 is preferably Velcro® of the opposite type to that which is disposed on the front of strap 20 in attachment portion 14 such that hook mechanism 30 may be releasably attached to strap 20 of caddy 1, but may be any material in the art known to provide a secure releasable attachment to strap 20. Attachment means 31 may be positioned on either side of strap 32 and the side on which it is positioned is selected to cooperatively engage with attachment means 14 which also may be positioned on either side of the strap 20. The length of hook mechanism 30, when accounting for the depth of U-shaped hook 33, is preferably of a size such that when attached to strap 20 as described herein, combines with strap 20 to span the front-to-back distance of the seat base of a typical stadium seat as shown in FIG. 1. Thus, the length of hook mechanism from hook 33 to its termination at attachment means 31 is preferably between three and ten inches, and is most preferably approximately six inches. In use, hook 33 is fitted onto the back edge of the seat base of the users seat S as shown in FIG. 1, and then attachment means 31 on hook mechanism 30 is attached to attachment portion 14 on the front of caddy 1 such that strap 20 extends over the front portion of the seat base and body 10 drapes over the front edge of the seat base as shown in FIG. 1. It should be noted that in this embodiment, the lengths of attachment means 31 and 14, as measured along the longitudinal dimension of straps 20, 32 is designed to be such that the point of attachment between caddy 1 and hook mechanism 30 may be varied along the plane of the seat base. In this way, the user can adjust the caddy 1 and hook mechanism 30 to fit on nearly any stadium seat base. Caddy 1 with optional hook mechanism 30 is shown with a typical stadium seat in a closed position, wherein the seat base folds up against the seat back, in FIG. 3.

When using caddy 1 with optional hook mechanism 30, the user, while seated in his own seat, can access items in the caddy's pockets by reaching to the front of his own seat and/or between his knees. This adaptation allows the caddy 1 to be completely out of the way of any foot traffic in the aisles between seats in a typical stadium, and also to not intrude on the personal space of any other spectators. The caddy 1 is kept up off the ground of the stadium to prevent any personal belongings of the user away from any dirt or other debris that might be present there, and is always maintained in an upright or vertical position to prevent its contents from spilling out, as shown in FIGS. 1 and 3. As depicted in FIG. 3, when the user is not sitting in the seat S such that the seat bottom is manually or automatically folded up against the seat back, the joint operation of straps 20, 32 maintain the top edge of the caddy body 10 at the front edge of the seat bottom but permit the body 10 of caddy 1 to fold or pivot over the front edge of the seat bottom at its top edge in order to maintain the pockets P are maintained in an upright or vertical position. This ensures that the contents of the pockets are not spilled out or lost and also allows caddy 1 to remain out of the way of any spectators who might be passing in front of seat S. As can be appreciated, the configuration of straps 20, 32 also allows the seat base to fold fully against the back of seat S to further widen the aisle of passage for spectators in front of seat S.

Accordingly, the instant invention provides a removable organization device for releasable attachment onto a typical stadium seat in two fashions, wherein the personal belongings of the user are kept in an upright position, off the ground, and out of the way of any pedestrian traffic or other spectators. In addition, the instant invention is sized and designed to securely hold multiple personal items of different sizes in a device that the user can carry with him to multiple events at different stadiums. This application is intended to cover any variations, uses, or adaptations of the invention using its general principles. Further, this application is intended to cover such departures from the present disclosure as come within known or customary practice in the art to which this invention pertains.

I claim:

1. A seat caddy that is releasably attached in a vertical orientation to a stadium seat having horizontally disposed seatback slats, or alternatively to a seat bottom pivotable at a back edge thereof, comprising:

in a first configuration, in which the seatback has horizontally disposed seatback slats, a body portion having one or more pockets on a first side and a first complementary attachment means on a second side; and a first strap portion extending from a top edge of said body portion, said strap portion having at a distal end a second complementary attachment means for selective engagement with said first complementary attachment means whereby a closed loop is formed around one of said horizontally disposed seatback slats so as to secure said caddy thereto in a vertical orientation; and in a second configuration, in which the seat bottom is pivotable at a back edge, further comprising a second strap portion having at a first end a hook element and at a second end a third complementary attachment means for selective engagement with said second complementary attachment means whereby said hook element is disposed toward said second side of said body portion such that said body portion is rotatably secured in a vertical orientation to a front edge of said seat bottom when said hook element is engaged to said back edge of said seat bottom.

2. The seat caddy of claim 1, wherein said complementary attachment means are hook-and-loop fasteners.

3. The seat caddy of claim 1, wherein said complementary attachment means are a plurality of snap fasteners.

4. The seat caddy of claim 1, wherein said second attachment means is positioned on first side of said first strap portion.

5. The seat caddy of claim 1 wherein said one or more pockets include an opening that is selectively and releasably closeable by a temporary attachment means.

6. The seat caddy of claim 1 further comprising a tab protruding from an edge of said body portion, a hole through said tab, and a grommet placed in said hole to secure a key ring thereto.

7. The seat caddy of claim 1 wherein said seat caddy is formed from synthetic or canvas fabric.

8. The seat caddy of claim 1 wherein said body portion is between six and twelve inches in height.

9. The seat caddy of claim 1 wherein said body portion is between ten and sixteen inches in width.

10. A method of securely organizing personal items in a vertical orientation to a stadium seat having horizontally disposed seatback slats, or alternatively a seat bottom pivotable at a back edge thereof, the method comprising:

providing a seat caddy having a body portion having one or more pockets on a first side and a first complementary attachment means on a second side, and a first strap portion extending from a top edge of said body portion, said strap portion having at a distal end a second complementary attachment means for selective engagement with said first complementary attachment means, and providing a second strap portion having at a first end a hook element and at a second end a third complementary attachment means for selective engagement with said second complementary attachment means whereby said hook element is disposed toward said second side of said body portion, in a first configuration, in which the seatback has horizontally disposed seatback slats, forming said first strap portion into a closed loop around one of said horizontally disposed seatback slats and securing said first complementary attachment means to said second complementary attachment means so as to secure said caddy to said seatback in a vertical orientation, or alternately, in a second configuration, in which the seat bottom is pivotable at a back edge, securing said hook element to said back edge of said seat bottom such that said second strap portion is disposed on a surface of said seat bottom, positioning said body portion at a front edge of said seat bottom, and securing said third complementary attachment means to said second complementary attachment means to join said first and second strap portions such that a combined length of said joined first and second strap portions equals a depth of said seat bottom so as to retain said body portion to said front edge of said seat bottom in a vertical orientation when said hook element is engaged to said back edge of said seat bottom.

* * * * *